United States Patent [19]

Akagi et al.

[11] 4,407,916

[45] Oct. 4, 1983

[54] PROCESS FOR FORMING FLUORESCENT SCREEN

[75] Inventors: Motoo Akagi, Hinodemachi; Shoichi Uchino, Hachioji; Saburo Nonogaki, Tokyo, all of Japan

[73] Assignee: Hitachi, Ltd., Tokyo, Japan

[21] Appl. No.: 358,263

[22] Filed: Mar. 15, 1982

[30] Foreign Application Priority Data

Mar. 19, 1981 [JP] Japan ..... 56-37636[U]
Feb. 1, 1982 [JP] Japan ..... 57-13279

[51] Int. Cl.[3] ..... G03C 5/00

[52] U.S. Cl. ..... 430/23; 430/26; 430/28; 430/29; 430/144; 430/291

[58] Field of Search ..... 430/23, 29, 144, 291, 430/26, 28

[56] References Cited

U.S. PATENT DOCUMENTS 2,840,470 6/1958 Levine ..... 430/29
4,269,918 5/1981 Nonogaki et al. ..... 430/144
4,273,842 6/1981 Nonogaki et al. ..... 430/144
4,276,363 6/1981 Manabe et al. ..... 430/144
4,334,009 6/1982 Charles et al. ..... 430/291

*Primary Examiner*—J. Travis Brown
*Attorney, Agent, or Firm*—Antonelli, Terry & Wands

[57] ABSTRACT

A process for forming a fluorescent screen, where polychroic patterns are successively formed from at least two kinds of phosphors having different color emission or black powder by means of a photosensitive substance capable of turning tacky by light irradiation, which comprises bringing a finer particulate filling material than particles of the phosphors in contact with tackified parts when or after the particles of the phosphors are applied to the tackified parts in the individual steps of forming patterns each of the individual phosphors. The filling material saturates the tackiness of the phosphor pattern in question in advance to formation of a phosphor pattern in the successive step, and a cause for contamination of the pattern of the preceding step with the phosphor of the successive step can be eliminated thereby.

23 Claims, 5 Drawing Figures

PROCESS FOR FORMING FLUORESCENT SCREEN

BACKGROUND OF THE INVENTION

The present invention relates to a process for forming a fluorescent screen, and more particularly to a process for forming a fluorescent screen suitable for the cathode ray tube.

The inside surface of the face plate of a cathode ray tube is coated with three kinds of phosphors each emitting red, green and blue in a dot or stripe pattern. According to the conventional process, such phosphor coating layers are formed as follows: First of all, a layer of first phosphor, for example, a mixture of green-emitting phosphor and photosensitive resin, is formed on the inside surface of the face plate. As the photosensitive resin, a mixture of polyvinyl alcohol and ammonium dichromate is usually used. The layer is formed usually by coating the inside surface of the face plate with a mixture of a solution of photosensitive resin with the phosphor, followed by drying of the coating. Then, the resulting layer is irradiated with ultraviolet rays through a shadow mask. The positions to be irradiated by the ultraviolet rays should correspond to the positions which electron beams are to hit to make the phosphor undergo emission, that is, the positions to which the phosphor is to be fixed. The photosensitive resin at the irradiated positions are insolubilized, and the layer at these positions is entirely insolubilized thereby. Then, the layer is washed with a solvent, normally water, to remove other parts of the layer by dissolution while retaining only the insolubilized parts obtained by the ultraviolet irradiation. Then, similar operations are carried out with another mixture of second phosphor, for example, blue-emitting phosphor, with the photosensitive resin, and then with other mixture of third phosphor, for example, red-emitting phosphor, with the photosensitive resin.

As is obvious from the foregoing, the process for forming a fluorescent screen for a cathode ray tube is complicated and requires a plurality of wet coating operations and repetitions of water washing and drying operations. Thus, simplification of the process has been keenly desirable.

To improve the said problem of the prior art, some of the present inventors proposed a process for forming a pattern of given phosphor by providing a thin layer of photosensitive substance that can turn tacky by light irradiation, for example, aromatic diazonium satl, onto the surface of a substrate, then exposing the thin layer to light through a shadow mask, thereby tackifying the pattern parts destined for the phosphor, and depositing phosphor particles onto the tackified pattern parts by adhesion (U.S. Pat. No. 4,273,842).

Another process was proposed for producing black matrix or black stripes by forming a fluorescent screen for a cathode ray tube according to the foregoing process, and then depositing black powder such as carbon powder, etc. onto the marginal parts of the phosphor pattern. However, in the production of a fluorescent screen for a cathode ray tube according to the foregoing process, such phenomena sometimes occur that, when a pattern of red-emitting phosphor is formed after the formation of a pattern of blue-emitting phosphor, the blue emission from the pattern of blue-emitting phosphor is contaminated with some red emission. Generally, there has been such a problem that the individual zones of three kinds of phosphors, i.e., blue-emitting, green-emitting and red-emitting phosphors, are liable to be contaminated with the phosphors emitting other color, with the result that the so-called color contamination phenomena are likely to appear, lowering the color purity.

In the case of using black powder, the individual zones of phosphors are often contaminated with black powder, lowering the brightness of fluorescent screen. This problem can be solved by providing a longer time in contacting a given phosphor with the light-exposed thin film, that is, by continuing the contact of the powder for a time long enough to saturate the light-exposed parts with the powder. However, provision of such a longer time only for one step is not preferable from the commercial viewpoint.

To improve such a problem, some of the present inventors proposed another process of using fixing powder (Japanese Laid-open Patent Application No. 32332/80), in which, after coating of phosphor powder, a powdery solid substance capable of forming a water-insoluble or sparingly water-soluble substance through reaction with photolytic products of a photosensitive substance is brought in contact with the coating layer of the phosphor powder. In the case of using, for example, an aromatic diazonium chloride-zinc chloride double salt as a photosensitive substance where zinc chloride is its photolytic products, calcium hydroxide, sodium hydrogen carbonate, sodium carbonate, etc. are used as a fixing powder. Deposition of the desired amount of phosphor powder onto the light-exposed parts (the tackified parts) of the thin layer takes only a short time, but saturation of the light-exposed parts with the deposited phosphor takes a longer time so that they may not be contaminated with other phosphor powder. That is, the proposed process can solve the problem of color contamination by operation of short duration.

However, the proposed process has brought about another problem. If the excess fixing powder is not completely removed from the light-unexposed parts of the thin layer and if even a very small amount of the fixing powder remains thereon, and if there is the fixing powder on the second, light-exposed parts, the thin layer turns tacky by light exposure and at the same time undergoes fixation. Accordingly, deposition of the second phosphor powder onto such parts cannot be carried out, though the phosphor is not deposited onto a whole dot of the phosphor pattern. In other words, the amount of phosphor to be deposited is extremely reduced, lowering the brightness of dot. Thus, drying and preservation of fixing powder, control of working atmosphere, removal of fixing powder, etc. must be carefully carried out. Otherwise, the product yield is inevitably lowered.

SUMMARY OF THE INVENTION

An object of the present invention is to provide a process for rapidly forming a phosphor pattern without color contamination.

This object and other objects, which will be apparent from the disclosure that follows, are attained according to a process for forming a fluorescent screen, where patterns each of individual phosphors are formed in zones discrete from one phosphor to another on a substrate surface from at least two kinds of phosphors, which comprises (1) a first step of applying a thin layer of a photosensitive substance capable of turning tacky by light exposure, (2) a second step of exposing the thin layer to light irradiation according to a pattern of one kind of the phosphors, thereby tackifying the light-exposed parts, and (3) a third step of applying particles of the said one kind of the phosphors and a finer particulate filling material than the particles of the phosphor to the tackified parts of the thin layer after the light exposure, thereby forming the pattern of the said one kind of the phosphors.

DETAILED DESCRIPTION OF PREFERRED EMBODIMENTS

Figure 1A:
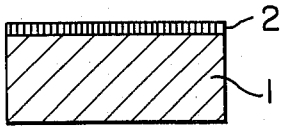
FIG. 1*a*, FIG. 1*b*, and FIG. 1*c* are schematic, partly enlarged cross-sectional views showing one embodiment of steps for forming fluorescent screens according to the present invention.

The present invention provides a process for forming a fluorescent screen, where polychroic patterns are formed from at least two kinds of phosphors having different color emissions, characterized in that, in the individual steps of forming patterns each of the individual phosphors when the individual patterns are formed successively, a finer particulate filling agent than the particles of the phosphor in question is brought in contact with the tackified pattern when or after the particles of the phosphor are applied to the tackified pattern, thereby saturating the tackiness of the phosphor pattern in question with the filling material in advance to formation of phosphor pattern or black powder pattern in the successive step. Accordingly, the pattern of the preceding step is not contaminated with the phosphor or black powder of the successive step, and thus a fluorescent screen can be formed rapidly.

Patterns of all kinds of the phosphors or black powder can be formed in zones discrete from one kind to another from at least two kinds of the phosphors or black powder by successively carrying out the said second and third steps with other kinds of the individual phosphors or black powder than the said one kind of the phosphor. A final pattern can be formed only from phosphor or black powder without using any filling material. In the application of one kind of the phosphor and a finer particulate filling material than the particles of the phosphor in question to the tackified parts of the thin layer in the said third step after the light exposure, any of the following procedures can be taken: (1) the filler material is applied to the tackified parts after the application of the particles of phosphor thereto, (2) a mixture of the particles of phosphor and the filling material, preferably a mixture thereof containing 5–30% by weight, preferably 10–20% by weight, of the filling material on the basis of the phosphor, is applied thereto, and (3) after the application of the particles of phosphor, a mixture of the particles of phosphor and the filling material, preferably a mixture thereof containing 10–60 % by weight of the filling material on the basis of the phosphor, is applied thereto. The procedure (1) or (3) is preferable for deposition of a sufficient amount of phosphor.

Inorganic or organic filling material can be used in the present invention, so long as its average particle size is smaller than that of the particles of phosphor. Preferable filling material has an average particle size of 0.1–3 μm, preferably 0.1–1 μm. The filling material can be used alone or in mixture. Inorganic filling material includes fine powder having no absorption band in the visible range such as silica, $MgCO_3$, metal phosphate, for example, magnesium phosphate, and further includes fine powders of phosphor capable of emitting substantially the same color as the phosphor to be used. Generally, an average particle size of the particles of phosphor for cathode ray tubes is 5–15 μm, preferably 5–12 μm, because phosphor having a very small average particle size has lower brightness. That is, so far as the necessary brightness is obtained by deposition of a sufficient amount of the particles of phosphor having the ordinary particle size, finer particles of phosphor having a low brightness can be used as the filling material. Since the emission from the finer particles of phosphor as the filling material joins into the emission from the ordinary particles of phosphor, the brightness can be increased on the whole, though to a slightest degree. In that case, the phosphor layer is treated with finer particles of phosphor as the filling material, and then the filling material on the unexposed parts must be carefully removed, because the filling material, if it remains on the positions, at which particles of phosphor are to be deposited in the successive step, will be a cause for color contamination. However, the brightness of finer particles of phosphor is so low, as already described above, that a very small amount of remaining finer particles is not objectionable. The finer particles of phosphor as the filling material must emit substantially same color as that of the ordinary particles of phosphor. For example, when $Y_2O_2S$: Eu is used as a red emitting phosphor, finer particles of the same phosphor, i.e. $Y_2O_2S$: Eu, or finer particles of other red emitting phosphor can be used.

As the organic filling material, finer particles of a polymer incapable of forming color contamination due to fogging of phosphor and having a heat decomposition point of less than 450° C. can be used, when applied as a binder for a photosensitive substance capable of turning tacky by light irradiation. Such material includes alginic acid or its salts, such as sodium alginate, methylcellulose, hydroxypropylmethylcellulose, copolymer of vinylmethylether-maleic acid anhydride (Gantrez: trademark), polystyrene, poly-α-methylstyrene, polymethyl acrylate, polymethyl methacrylate, polyvinylidene chloride, polyvinyl acetate, etc.

Preferable property required for the filling material is that it can be promptly removed from the unexposed parts after the treatment of phosphor layer. Metal phosphate has such a property as above, in contrast to $SiO_2$, etc. Metal phosphate includes $M_3(PO_4)_2$, where M is at least one of Mg, Ca, Sr, Ba, and Zn, $M'PO_4$, where M' is at least one of La, Ce, Sm, Eu, Gd, Tb, Dy, Ho, Er, Tm, Yb, Al, Ga, In, Sc, and Y, $Al(PO_3)_3$, $M''(PO_3)_2$, where M'' is at least one of Ca and Sn, etc.

The present photo-sensitive material is preferably a material containing, as a photosensitive component, an aromatic diazonium salt disclosed in U.S. Pat. No. 4,273,842 to some of the present inventors. Such diazonium salt includes an aromatic diazonium chloride-zinc chloride double salt (for example, 4-dimethylaminobenzenediazonium chloride-zinc chloride double salt, etc.), an aromatic diazonium acidic sulfate (for example, 4-diethylaminobenzenediazonium sulfate, etc.), etc.

To improve an applicability of a photosensitive substance when used as a coating material, it is desirable that the photosensitive substance contains 0.5–500% by weight, preferably 1–50% by weight, of an organic polymer compound, on the basis of the aromatic diazonium salt, as disclosed in the said U.S. Pat. No. 4,273,842. As the applicable organic polymer compound is at least one of organic polymer compounds selected from the group consisting of gum arabic, polyvinyl alcohol, polyacrylamide, poly(N-vinylpyrrolidone), acrylamide-diacetoneacrylamide copolymer, methylvinylether-maleic acid anhydride copolymer, alginic acid, glycol ester of alginic acid, and hydroxypropylmethyl cellulose.

Addition of various surfactants has been already proposed for the same purpose as above, and such surfactants can be also used in the present invention. Preferable amount of the surfactant to be added is 0.01–1% by weight on the basis of the diazonium salt.

Figure 1B:
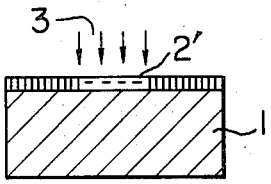
Figure 1C:
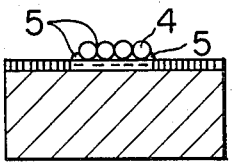

States of the particles of phosphor and the finer particles of filling material in the present process for forming patterns of phosphor are shown in FIG. 1*a*, FIG. 1*b* and FIG. 1*c* as partly enlarged cross-sectional views. As shown in FIG. 1*a*, a thin layer 2 of photo-sensitive material is formed on a substrate 1, and then, as shown in FIG. 1*b*, a zone 2' light-exposed by light irradiation 3 is tackified. When the phosphor and the filling material are applied to the tackified part, the particles 4 of phosphor are fixed to the tackified part by adhesion, and at the same time the filling material 5 makes filling in clearances between the particles of phosphor, and between tackified part, the particles of phosphor and unexposed part (non-tackified part), as shown in FIG. 1*c*. In the case of successive application of phosphors emitting different colors or black powder to the respective tackified patterns, the tackified pattern surfce is substantially completely covered by the particles 4 of phosphor and the finer particulate filling material 5 according to the present invention, whereas according to the prior art process, some tackified, exposed parts remain between the particles of phosphor and at the boundaries between the particles of phosphor and the pattern zone, and thus there is a possibility of fixing other kind of phosphor or black powder to the said remaining exposed parts by adhesion in the successive step. The fixation of other kind of phosphor to the remaining exposed part is a cause for color contamination.

The present invention will be described in detail, referring to Examples.

EXAMPLE 1

To investigate the effect of finer particles of aluminum phosphate ($AlPO_4$) as a filling material, the following test was conducted.

A photosensitive composition capable of turning tacky by light irradiation and containing 4-dimethylaminobenzenediazonium chloride-zinc chloride double salt was applied to a glass panel, and irradiated with light through a shadow mask to tackify the positions at which a blue emitting phosphor is to be deposited. Blue emitting phosphor, ZnS: Ag, Cl, which was surface treated with colloidal silica in advance, ($SiO_2$ content: 0.2% by weight) was applied thereto. Then, the excess ZnS: Ag, Cl was removed by air spray, and the phosphor-deposited surfaces were treated with finer particles of $AlPO_4$ (average particle size: 3 μm), and then the excess filling material was removed by air spray. Successively, green emitting phosphor ZnS: Cu, Au, Al, which was surface treated successively with colloidal silica and $Zn(OH)_2$ in advance ($SiO_2$ content: 0.15% by weight and $Zn(OH)_2$ content: 0.35% by weight), and red emitting phosphor $Y_2O_2S$: Eu, which was surface treated with $Zn(OH)_2$ and $Zn_3(PO_4)$ ($Zn(OH)_2$ content: 0.2% by weight and $Zn_3(PO_4)_2$ content: 0.2% by weight) were applied thereto and subjected to removal by air spray in the same manner as above, to form a fluorescent screen. The fluorescent screen was not treated with finer particles of $AlPO_4$ at the application of $Y_2O_2S$: Eu. For comparison, another fluorescent screen was prepared in the same maner as above except that no treatment with the finer particles of $AlPO_4$ was made at all.

When no treatment with the finer particles of $AlPO_4$ was made at all, contamination of blue emitting phosphor layer with green emitting phosphor particles was found to be in an average ratio of 100 particles per 1 mm×0.16 mm area of the phosphor layer, contamination of blue emitting phosphor layer with red emitting phosphor particles in an average ratio of 200 particles, and contamination of green emitting phosphor layer with red emitting phosphor particles in an average ratio of 200 particles, and the so-called color contamination phenomenon appeared. On the other hand, when filling treatment was carried out with the finer particles of $AlPO_4$, contamination of the respective phosphor layers with other kinds of color emitting phosphor particles was found to be in an average ratio of less than 10 particles for each kind.

EXAMPLE 2

Fluorescent screens were prepared in the same manner as in Example 1, except that finer particles of $Zn_3(PO_4)_2$ (average particle size: 1 μm) was used as the filling material, when required.

When no treatment was made with the finer particles of $Zn_3(PO_4)_2$, contamination of blue emitting phosphor layer with green emitting phosphor particles was found to be in an average ratio of 100 particles per 1 mm×0.16 mm area of the phosphor layer, contamination of blue emitting phosphor layer with red emitting phosphor particles in an average ratio of 200 particles, and contamination of green emitting phosphor layer with red emitting phosphor particles in an average ratio of 200, and the so-called color contamination phenomenon appeared. On the other hand, when the filling treatment was carried out with finer particles of $Zn_3(PO_4)_2$ according to the present invention, contamination of the respective phosphor layers with other kinds of color emitting phosphor particles was found to be in an average ratio of less than 10 particles for each kind.

EXAMPLE 3

Fluorescent screens were prepared in the same manner as in Example 1, using finer powderes of $AlPO_4$ as a filling material, when required. After application of $Y_2O_2S$: Eu, the resulting layer was treated with finer particles of $AlPO_4$ (average particle size: 3 μm), and then the entire surface of glass panel was subjected to light irradiation without using a shadow mask, thereby tackifying all other zones than the phosphor pattern. Powder of tricobalt tetraoxide as black powder was applied thereto and developed.

When no treatment was carried out with the finer particles of $AlPO_4$, not only color contamination phenomenon of phosphor appeared, but also contamination of the respective emitting phosphor patterns with tricobalt tetraoxide was found.

On the other hand, when the filling treatment was carried out with the finer particles of $AlPO_4$, the degree of contamination of the respective phosphor layers with other kinds of color emitting phosphor particles was reduced to 1/10–1/20 and also the degree of contamination of the respective emitting phosphor layers with the black powder was reduced to ½–⅓.

EXAMPLE 4

To investigate the effect of using much finer particles of phosphor as a filling material, the following test was carried out.

The same photosensitive material as used in Example 1 was applied to a glass panel, and subjected to light irradiation through a shadow mask to tackify a blue zone. Then, blue emitting phosphor particles (average particle size: 10 μm) were applied thereto, and the resulting phosphor layer was treated with much finer phosphor particles of the same color emission (average particle size: 1 μm), and then the excess filling material was removed by air spray. Successively, green emitting phosphor particles and red emitting phosphor particles were likewise applied thereto, and subjected to removal by air spray to prepare a fluorescent screen.

On the other hand, another fluorescent screen was prepared in the same manner as above, except that no treatment was made with the much finer particles of phosphor.

When no treatment was made with the much finer particles of phosphate, contamination into between the blue zone and the red zone with green emitting phosphor particles was observed, and contamination with the green emitting phosphor particles was found to be in an average ratio of 25 particles per 1 mm wide boundary between the blue zone and the red zone.

On the other hand, when the filling treatment was made with the much finer particles of phosphor, no contamination into the boundary between the blue zone and the red zone by green emitting phosphor particles was observed. The effect of much finer particles of phosphor upon prevention of color contamination was ascertained.

EXAMPLE 5

To investigate the effect of finer particles of silica ($SiO_2$) as a filling material, the following test was carried out.

A photosensitive material capable of turning tacky by light exposure was applied to a glass panel, and subjected to light irradiation through a shadow mask to tackify the blue zone. Then, blue emitting phosphor particles were applied thereto, and then the resulting phosphor layer was treated with finer particles of silica. Then, the excess finer particles of silica were removed by air spraying. Successively, green emitting phosphor particles and red emitting phosphor particles were likewise applied thereto and treated with the finer particles of silica to prepare a fluorescent screen.

For comparison, another fluorescent screen was prepared in the same manner as above, except that no treatment was made with the finer particles of silica.

When no treatment was made with the finer particles of silica, contamination into between the blue zone and the red zone with green emitting phosphor particles was observed, and contamination of 25 green emitting phosphor particles in 1 mm-wide boundary between the blue zone and the red zone was found on average. Thus, the so-called color contamination phenomenon appeared.

On the other hand, when the filling treatment was carried out with the finer particles of silica according to the present invention, no contamination of the respective zones with other kinds of color emitting phosphor particles was observed, and thus no color contamination was found.

EXAMPLE 6

To investigate the effect of filling materials upon the prevention of color contamination, a thin layer of the same photo-sensitive material as in Example 5 was formed, and subjected to light exposure to turn tacky, and then blue emitting phosphor particles was applied thereto, and then red emitting phosphor particles was applied thereto. Emission spectrum of the resulting fluorescent screen was investigated as a comparative example.

Figure 2:
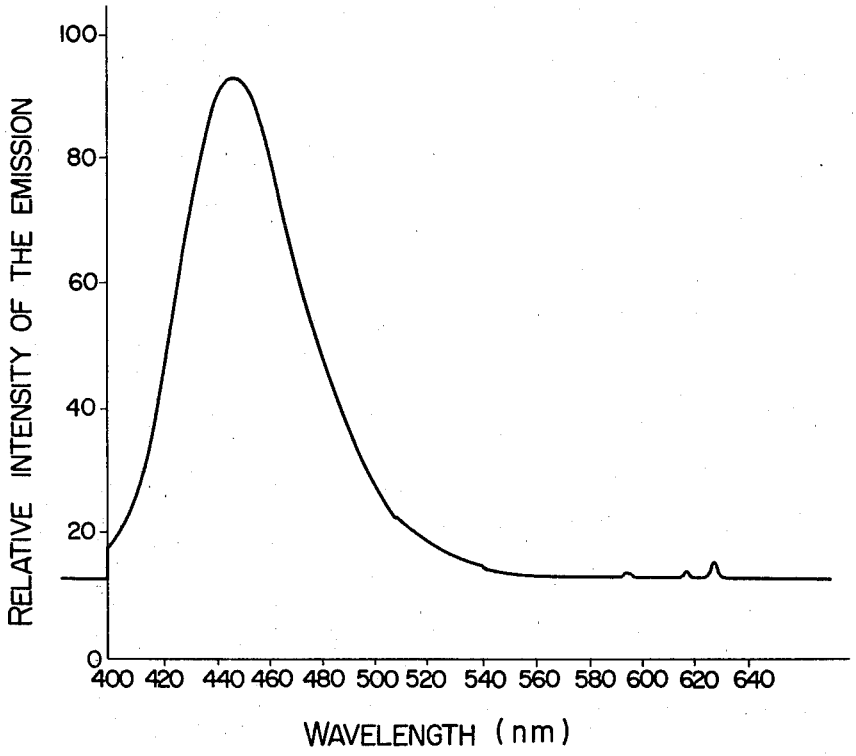
FIG. 2 is a diagram of emission spectra distribution in a blue-emitting phosphor zone according to the present invention.
Figure 3:
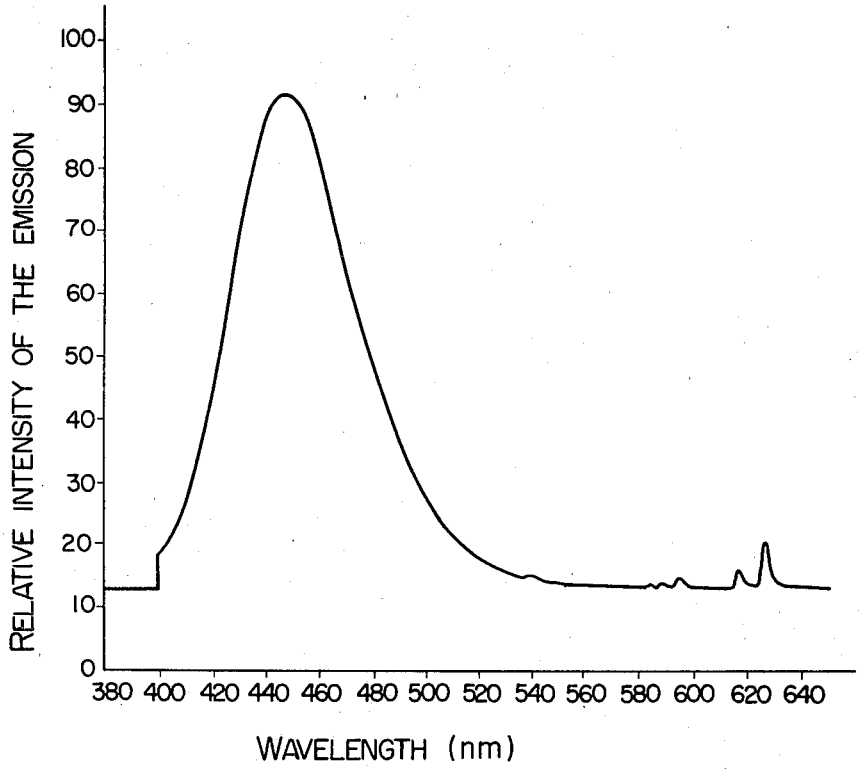
FIG. 3 is a diagram of emission spectra distribution in a blue-emitting phosphor zone according to the conventional process.

On the other hand, as one embodiment according to the present invention, another fluorescent screen was prepared in the same manner as above except that blue emitting phosphor particles containing 10% by weight of vinylmethylether-maleic acid anhydride polymer particles (average particle size: 1 μm, Gantrez, trademark of GAF Co.) as a filling material on the basis of the phosphor particles was used. Emission spectrum of the resulting fluorescent screen was investigated as shown in FIG. 2. Substantially no peaks were observed in 610–640 nm, the emission wavelength of red emitting phosphor particles. On the other hand, the emission spectrum, when no treatment was made with the filling material, is as given in FIG. 3, and considerable emission peaks were observed in 610–640 nm, the emission wavelength of red emitting phosphor particles.

The effect of the filling material upon preventing color contamination according to the present invention was ascertained.

EXAMPLE 7

When three kinds of blue, green and red emitting phosphors were applied to a substrate in this order according to the conventional process using a photosensitive material capable of turning tacky by light exposure without any filling material, the time for application of red emitting phosphor was ⅛ of the time for blue or green emitting phosphor. The reason why the time for application of preceding green emitting phosphor and the time for application of further preceding blue emitting phosphor were each 8 times the time for red emitting phosphor was that the tackiness was not fully satisfied, so that the appearance of color contamination phenomenon had to be prevented. The red emitting phosphor, which was to be finally applied thereto, had no possibility of unsaturation, and thus, could be fully applied for a time as short as ⅛.

On the other hand, when the filling treatment was carried out according to the present invention, the treating time could be considerably shortened. That is, when application of blue emitting phosphor particles was carried out for a time as short as ⅛ of that of the conventional process, that is, for the same duration as that for application of red emitting phosphor particles according to the conventional process, and when treatment with finer particles of $SiO_2$ and finer particles of vinylmethylether-maleic acid anhydride copolymer (Gantrez, a trademark) as filling materials (particle size of filling materials: less than 1 μm) was made for a time as short as $\frac{1}{3}$ of that for applying the red emitting phosphor particles according to the conventional process, no substantial color contamination was observed even if the successive application of green emitting phosphor particles was made. Furthermore, application of the green emitting phosphor particles and application of finer particles of the filling material could be made in the same manner as in the case of application of the blue emitting phosphor particles without any problem. In other words, when the time of application of blue emitting phosphor particles and green emitting phosphor particles according to the conventional process is presumed to be $T_1$, sum total of the time of application of the phosphor particles and the time of application of the finer particles of filling material amounts to less than 0.19 $T_1$ according to the present invention. That is, the treating time can be greatly shortened according to the present invention.

The present invention not only solve the quality problem of color contamination, but also has an economical merit of shortening the treating time.

What is claimed is:

1. A process for forming a fluorescent screen, where patterns each of individual phosphors are formed in zones discrete from one phosphor to another on a substrate surface from at least two kinds of phosphors, which comprises (1) a first step of applying a thin layer of a photosensitive substance capable of turning tacky by light exposure, (2) a second step of exposing the thin layer to light irradiation according to a pattern of one kind of the phosphors, thereby tackifying the light-exposed parts, and (3) a third step of applying particles of the said one kind of the phosphors, and a finer particulate filling material than the particles of the phosphor, to the tackified parts of the thin layer after the light exposure, said finer particulate filling material being at least one material selected from the group consisting of:

(i) metal phosphates;

(ii) $SiO_2$;

(iii) $MgCO_3$;

(iv) powders of organic polymer having a heat decomposition point of less than 450° C.; and (v) much finer particles of phosphor having substantially the same color emission as that of the phosphor in the phosphor layer to be treated with the finer particulate filling material, thereby forming the pattern of the said one kind of the phosphors having the finer particulate filling material filling in clearances between the phosphor particles and between the phosphor particles and peripheries of the tackified parts.

2. The process according to claim 1, wherein the third step is carried out by applying the particles of the said one kind of the phosphors at first, and then the finer particulate filling material to the tackified parts.

3. The process according to claim 1, wherein the third step is carried out by applying a mixture of the particles of the said one kind of the phosphors and the finer particulate filling material to the tackified parts.

4. The process according to claim 1, wherein the third step is carried out by applying the particles of the said one kind of phosphors at first, and then a mixture of the particles of the said one kind of the phosphors and the finer particulate filling material to the tackified parts.

5. The process according to any one of claims 1 to 4, wherein the finer particulate filling material is at least one compound selected from the group consisting of metal phosphates, $SiO_2$ and $MgCO_3$.

6. The process according to any one of claims 1 to 4, wherein the finer particulate filling material is at least one of said metal phosphates, and the at least one metal phosphate is selected from the group consisting of $M_3(PO_4)_2$, wherein M is at least one element selected from the group consisting of Mg, Ca, Sr, Ba and Zn, $M'PO_4$, wherein M' is at least one element selected from the group consisting of La, Ce, Sm, Eu, Gd, Tb, Dy, Ho, Er, Tm, Yb, Al, Ga, In, Sc and Y, $Al(PO_3)_3$ and $M''(PO_3)_2$, where M'' is at least one element selected from the group consisting of Ca and Sn.

7. The process according to any one of claims 1 to 4, wherein the finer particulate filing material is powders of organic polymer having a heat decomposition point of less than 450° C.

8. The process according to claim 7, wherein the organic polymer is at least one member selected from the group consisting of alginic acid, alginate, methylcellulose, hydroxypropylmethylcellulose, vinylmethylether-maleic acid anhydride copolymer, polystyrene, poly-α-methylstyrene, polymethyl acrylate, polymethyl methacrylate, polyvinylidene chloride, and polyvinyl acetate.

9. The process according to any one of claims 1 to 4, wherein the finer particulate filling material is much finer particles of phosphor having substantially the same color emission as that of the phosphor in the phosphor layer to be treated with the finer particulate filling material.

10. The process according to any one of claims 1 to 4, wherein the finer particulate filling material has an average particle size of 0.1–3 μm.

11. The process according to any one of claims 1 to 4, wherein the photosensitive substance contains an aromatic diazonium salt as a photosensitive component.

12. The process according to any one of claims 1 to 4, wherein the surface of the substrate is an inside surface of a face plate of a cathode ray tube.

13. The process according to claim 10, wherein the finer particulate filling material has an average particle size of 0.1–1 μm.

14. The process according to claim 13, wherein the average particle size of the particles of phosphor is 5–15 μm.

15. The process according to claim 3, wherein said mixture contains 5–30% by weight of the filling material on the basis of the phosphor.

16. The process according to claim 4, wherein said mixture contains 10–60% by weight of the filling material on the basis of the phosphor.

17. The process according to claim 1, further comprising the steps of exposing the thin layer to a second light irradiation, according to a pattern of a second kind of the phosphors, thereby tackifying the light-exposed parts, and then applying particles of said second kind of phosphor, and said finer particulate filling material than the particles of the second kind of phosphor, to the parts of the thin layer made tacky by the second light irradiation.

18. The process according to claim 17, further comprising the steps of exposing the thin layer to a third light irradiation, according to a pattern of a third kind of the phosphors, thereby tackifying the light-exposed parts, and then applying particles of said third kind of phosphor, and said finer particulate filling material than the particles of the third kind of phosphor, to the parts of the thin layer made tacky by the third light irradiation.

19. The process according to claim 18, wherein the three kinds of phosphors are blue-emitting phosphors, green-emitting phosphors, and red-emitting phosphors.

20. The process according to claim 1, wherein said finer particulate filling material fills in the clearances between said particles of the phosphor and between particles of the phosphor and the peripheries of the tackified parts.

21. A process for forming a fluorescent screen, where patterns each of individual phosphors are formed in zones discrete from one phosphor to another on a substrate surface from at least two kinds of phosphors, which comprises (1) a first step of applying a thin layer of a photosensitive substance capable of turning tacky by light exposure, (2) a second step of exposing the thin layer to light irradiation according to a pattern of one kind of the phosphors, thereby tackifying the light-exposed parts, and (3) a third step of applying particles having an average particle size of 5–15 μm of the said one kind of the phosphors, and a finer particulate filling material than the particles of the phosphor, which filling material has an average particle size of 0.1–3 μm and has no absorption band in the visible range, to the tackified parts of the thin layer after the light exposure, said finer particulate filling material filling in the clearances between said particles of the phosphor and between particles of the phosphor and the peripheries of the tackified parts, whereby the pattern of the said one kind of the phosphors having the finer particulate filling material filling in clearances between the phosphor particles and between the phosphor particles and peripheries of the tackified parts is formed.

22. The process according to claim 21, wherein the finer particulate filling material has an average particle size of 0.1–1 μm.

23. The process according to claim 21 or 22 wherein the photosensitive substance is a photosensitive material containing an aromatic diazonium salt as a photosensitive component.

* * * * *